United States Patent [19]

Levey

[11] 4,331,296

[45] May 25, 1982

[54] AIRLESS SPRAY TIP

[75] Inventor: Gustave S. Levey, Houston, Tex.

[73] Assignee: Speeflo Manufacturing Corporation, Houston, Tex.

[21] Appl. No.: 130,606

[22] Filed: Mar. 17, 1980

[51] Int. Cl.[3] ..... B05B 1/28

[52] U.S. Cl. ..... 239/288

[58] Field of Search ..... 239/288–288.5, 239/DIG. 22, 600

[56] References Cited

U.S. PATENT DOCUMENTS 4,025,045 5/1977 Kubiak ..... 239/288.5

4,036,438 7/1977 Soderlind et al. ..... 239/288.5

*Primary Examiner*—Andres Kashnikow

*Attorney, Agent, or Firm*—Pearne, Gordon, Sessions, McCoy & Granger

[57] ABSTRACT

A safety airless spray tip is disclosed having an integral guard extending from the forward end thereof to prevent accidental human injection by the liquid being sprayed. The guard comprises U-shaped wire members located on opposite sides of the spray opening to cooperatively define a protected three-dimensional space through which the emitted spray fan passes, the protected space being of sufficient dimension to prevent the injection of human skin pressed against the guard.

21 Claims, 3 Drawing Figures

AIRLESS SPRAY TIP

BACKGROUND OF THE INVENTION

The present invention relates to airless spraying apparatus for liquid such as paint and, more particularly, to a safety airless spray tip having an integral guard for preventing accidental human injection of a liquid being sprayed.

The airless spraying apparatus of concern herein hydraulically atomizes the liquid being sprayed and, accordingly, relatively high pressures (1,500 to 3,000 psi) capable of human injection are encountered. The emitted spray stream has a "flat fan" shape and it is of sufficient integrity to result in the injection of human skin at locations immediately adjacent the spray tip opening, the downstream atomization of the spray serving to thereafter break up the liquid to a degree which prohibits injection. Thus, a zone of potential injection exists in the emitted spray at the spray tip opening and persists downstream for a relatively short distance. The extent of the zone will vary in accordance with the operating pressure and kinetic energy of the emitted spray as well as the area of the spray opening. It has been found in most commercial and industrial airless spray applications that the zone of potential injection extends for a distance no greater than about $\frac{3}{8}$ of an inch as measured from the spray opening. However, it is possible in some very high volume or high energy applications with a narrow spray angle for the zone of potential injection to be as long as $\frac{5}{8}$ of an inch or longer.

The prior art discloses a number of protective guard structures for preventing human injection by airless spray apparatus. U.S. Pat. Nos. 3,952,955; 3,963,180 and 4,025,045 disclose relatively large, enclosure type structures characterized by continuous walls which surround or substantially surround the emitted spray adjacent the spray tip for a distance sufficient to prevent injection. These guards are removably mounted on the spray tip retainer nut or entrapped between the retainer nut and the spray tip. In addition, there is presently available an enclosure type guard which is permanently mounted on the retainer nut. This latter guard has a generally cylindrical configuration including a diametrically extending slot having outwardly tapering walls in the downstream direction to provide a spray-receiving region similar to that of the guard in U.S. Pat. No. 3,952,955.

The foregoing enclosure type guards are not satisfactory for a number of reasons. In some cases, the use of the guard requires a specially manufactured or modified retainer nut for purposes of mounting the guard and, frequently, the guard and/or the retainer nut must also include means to orient the guard with the spray tip and the emitted flat fan spray. Thus, such guards are not directly usable in conventional spray apparatus without specially fabricated mounting devices. Further, such guards typically involve additional assembly steps and may be inadvertently omitted when the spray tip is removed for cleaning or replacement. The relatively large, continuous walls of the enclosure type guards also tend to collect liquid or paint being sprayed and to adversely affect the flow of atomization air to the emitted spray. These latter deficiencies have been found sufficiently severe in the enclosure type guard presently being marketed to cause operators to intentionally and destructively remove the guards even though the guards are intended to be permanently mounted to the retainer nut.

U.S. Pat. No. 4,036,438 discloses an open frame type guard having a spray encircling barrier for use with cone-shaped sprays. The guard is removably mounted by means of entrapment between a spray nozzle and a mounting nut or by means of a depending coil spring resiliently engaging the outer periphery of the spray nozzle. The removable mounting arrangement of this guard gives rise to the same deficiencies as noted above with respect to the enclosure type guards, and it is not intended for use with flat fan sprays as contemplated herein.

SUMMARY OF THE INVENTION

As previously indicated, a safety airless spray tip is provided having an integral guard extending therefrom for purposes of preventing injection of human skin by a liquid being sprayed. The guard is integrally, permanently fixed or mounted to the spray tip and, therefore, it is directly mounted in the spray apparatus upon mounting of the spray tip.

The provision of the integral spray tip and guard reflects the discovery that protection against injection can be achieved through the use of a guard having minimized dimensions in flat fan spray techniques, as contrasted with the relatively large prior art enclosure type guard structures. The minimization of the guard dimensions as well as its overall structural bulk is to an extent achieved by providing the guard with a configuration specifically reflecting that of the emitted flat fan spray. Further, this discovery is particularly applied to spray apparatus wherein the spray tip is telescopically received within a retainer nut for purposes of mounting. More specifically, an effective guard has been developed having a maximum lateral or radial extent relative to the direction of liquid flow which is no greater than that of the spray tip, and therefore enables the continued use of telescopic mounting in conventional retainer nuts without special modification. Further, the integral spray tip and guard avoids the possible omission of the guard as in prior art structures, and its use does not give rise to any additional or different assembly or disassembly steps when the spray tip is mounted to or removed from the spray apparatus.

In the illustrated embodiment, the guard comprises an open frame structure having frame elements or barriers extending from the forward end of the spray tip. The frame elements cooperate to define a protected three-dimensional space adjacent the spray opening which is of sufficient dimension as measured from the spray opening to prevent human injection as, for example, when an operator is manipulating the tip with his fingers for adjustment purposes and spraying inadvertently occurs.

The minimization of the frame structure of the guard is to a degree achieved through the cooperative relationship of a number of frame elements to define the protected three-dimensional space. The cooperative effect of the frame elements is particularly efficient in the flat fan spray tips wherein the emitted spray initially assumes a generally planar configuration. As illustrated hereinafter, the guard comprises separate planar frame elements disposed on opposite sides of the spray fan. The frame elements are arranged too cooperate with one another to define the protected space adjacent the spray opening and to provide the protected space with a configuration which specifically reflects the planar characteristics in the zone of potential injection of the emitted spray.

The frame structure of the guard comprises a wire frame of hardened stainless steel or spring wire. The guard is provided by U-shaped wire loops located on each side of the spray fan, the bights of the U-shaped loops being remote from the spray tip and the plane of each of the loops being substantially parallel with the plane of the spray fan. This arrangement does not adversely affect the flow of atomization air or provide guard surfaces which tend to collect sprayed liquid such as paint so as to result in undesirable levels of liquid or paint build-up on the guard.

DETAILED DESCRIPTION OF THE DRAWINGS

Figure 1:
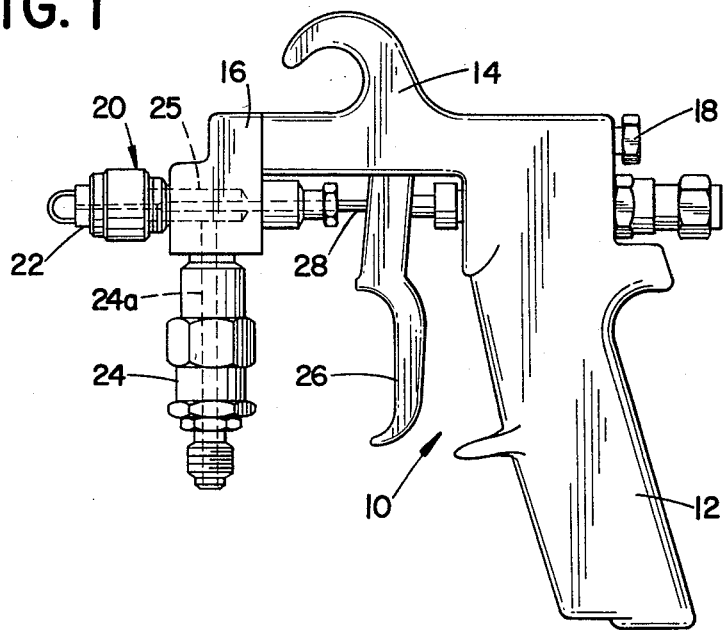
FIG. 1 is an elevational view of an airless spray gun having an integral spray tip and guard in accordance with the present invention.

Referring to FIG. 1, an airless spray gun 10 is shown. The spray gun includes a handle portion 12, a forwardly extending stock portion 14, and a spray portion 16 which is secured to the stock portion 14 by means of a bolt 18. A spray nozzle assembly 20 is connected to the forward end of the spray portion 16. An integral spray tip and guard assembly 22 is mounted within the spray nozzle assembly 20. The operation of the spray gun 10 is briefly described below in connection with the spraying of paint.

The paint to be sprayed is introduced into the spray gun 10 through a combined swivel fitting and strainer holder 24 which is threadedly connected to the spray portion 16 of the gun. The fitting 24 is adapted to be connected to a source of paint under pressure (not shown), and the paint is delivered to the internal portions of the gun through a passageway 24*a* extending through the fitting and communicating with a passageway 25. The paint may be pressurized in any conventional manner and introduced into the fitting 22 through a supply hose (not shown) as disclosed in U.S. Pat. No. 3,000,576 to Levey or a circulating system may be used as disclosed in U.S. Pat. No. 3,018,968 to Levey.

The spray gun 10 includes a pivoted trigger 26 which is fixed to a stem of a needle valve 28 for purposes of operating the spray gun. The spray gun is actuated upon movement of the trigger 26 towards the handle 12 and the corresponding, following movement of the needle valve 28 in a rearward direction.

Figure 2:
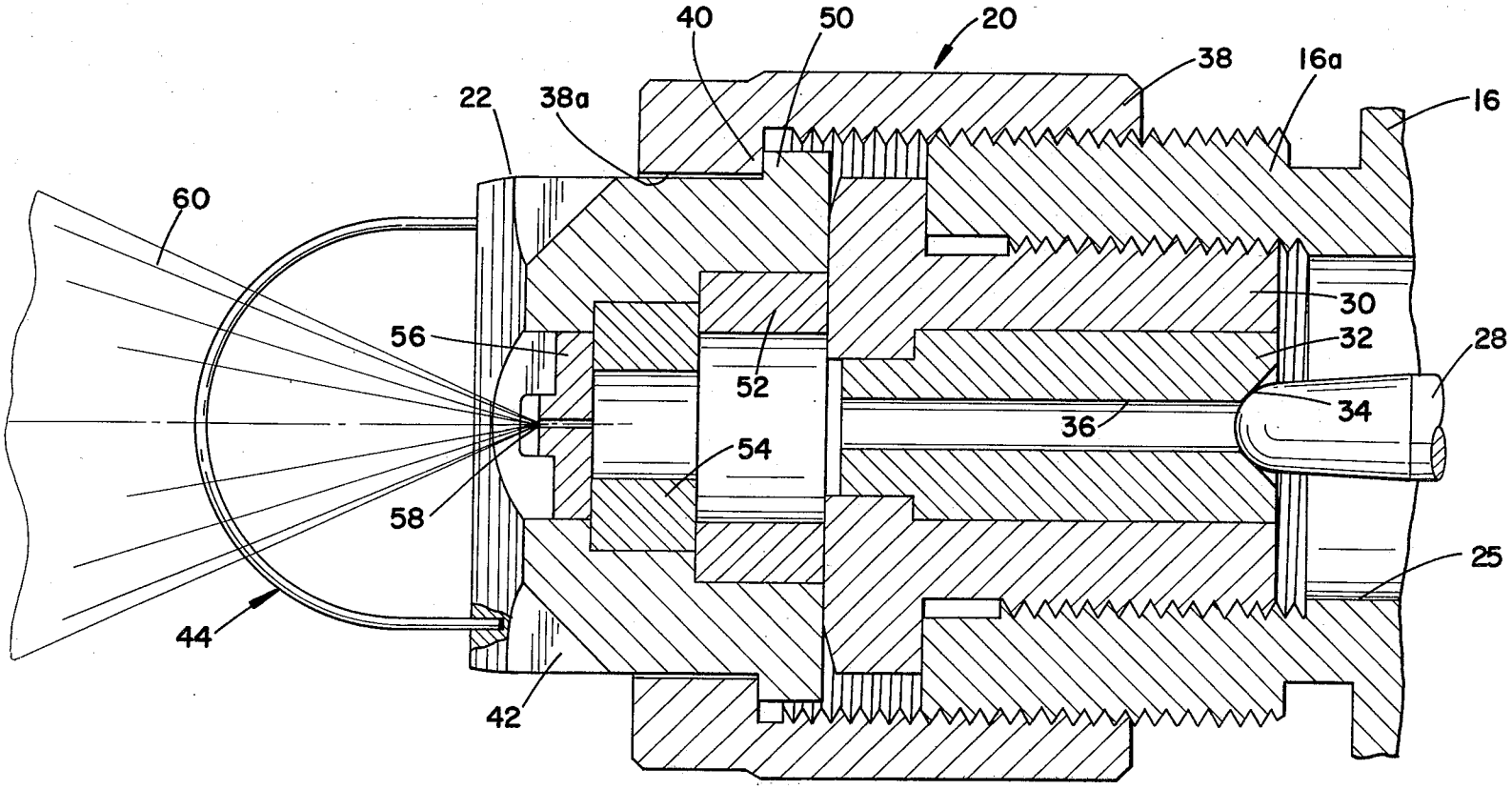
FIG. 2 is a fragmentary cross-sectional view on an enlarged scale showing the valve port and spray nozzle portion of the spray gun.

Referring to FIG. 2, the details of the spray portion 16 and spray nozzle assembly 20 are shown. A cylindrical boss 16*a* extends forwardly from the spray portion 16, and it is internally threaded for engagement with a nut 30 having a valve body 32 secured therein. The valve body 32 includes a valve seat 34 which cooperates with the needle valve 28 to control the flow of paint delivered through the passageway 25 for purposes of spraying. To that end, the valve body 32 also includes a valve port 36 which communicates with the spray tip and guard assembly 22.

The boss 16*a* of the spray portion 16 is also externally threaded to receive a retainer nut 38. The retainer nut 38 has an internal flange 40 for telescopically receiving and mounting the spray tip and guard assembly 22 to the spray gun.

The spray tip and guard assembly 22 comprises an airless spray tip 42 of conventional design which has been modified in accordance with the present invention to include an integral guard 44 extending from the forward or discharge end thereof. The spray tip 42 has a generally cylindrical configuration with opposed, longitudinally extending flats 46, 48 FIG. 3) which extend through a forward bore 38*a* of the retainer nut 38 for purposes of rotationally adjusting the spray tip 42. An external flange 50 is provided adjacent the rearward or inlet end of the spray tip 42, and it is engaged by the internal flange 40 of the retainer nut 38 for purposes of mounting the spray tip to the spray gun.

The spray tip 42 includes a spacer sleeve 52 and a tungsten carbide tip insert 54 having a reduced forward end portion 56 which are press fitted within suitable bores in the spray tip 42. Axially aligned bores in the sleeve 52, tip insert 54 and forward end portion 56 communicate with the valve port 36 for delivering paint to an oval-shaped spray opening 58 in the forward end portion 56. As shown in FIG. 2, the major dimension of the spray opening and the resulting flat fan spray 60 are parallel with the plane of the section. In less abrasive spraying applications, the spray tip 42 may be formed of a hard steel and provided in one piece without the use of the spacer sleeve 52 and the tungsten carbide tip insert 56.

Figure 3:
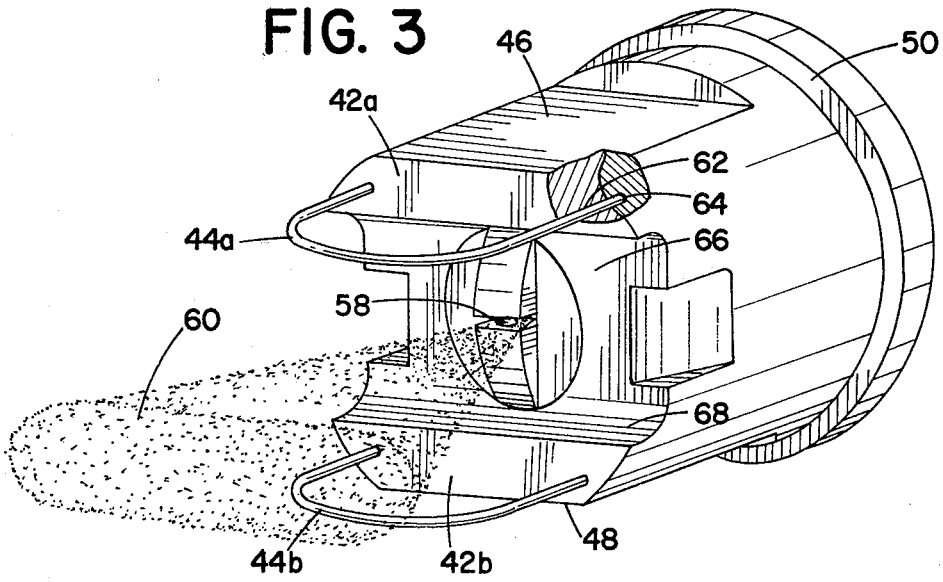
FIG. 3 is a perspective view on an enlarged scale of the airless spray tip and integral guard.

Referring to FIGS. 2 and 3, the guard 44 comprises a pair of U-shaped guard frame elements 44*a* and 44*b*. The frame elements 44*a* and 44*b* are respectively mounted to the flat front faces 42*a* and 42*b* of the spray tip 42. For purposes of permanently and integrally mounting the guard 44 to the spray tip, the ends of each of the elements 44*a*, 44*b* are received within bores 62 (only one of which is shown) and secured therein by suitable means such as an epoxy resin adhesive 64 which is substantially not affected by a wide range of paint solvents. Thus, the guard 44 is permanently associated with the spray tip 42 in a manner which discourages tampering and/or removal without structural damage to the guard and/or the spray tip.

The frame elements 44*a*, 44*b* are formed of stainless steel spring wire of about 0.040 inch in diameter. The gauge of the wire and configuration of the frame elements are selected to provide the guard with sufficient strength and rigidity to avoid distortion from its protective orientation as a result of the inadvertent bumping of the guard during normal usage of the spray gun or the dropping of the spray tip and guard assembly. The corrosion resistance of stainless steel is especially advantageous in spraying apparatus and its use herein affords the guard a useful life at least equal to that of the spray tip 42. Other hardened steels or materials displaying similar physical characteristics may be used to form the frame elements.

As shown in FIG. 3, the guard 44 and, more particularly, the frame elements 44*a*, 44*b* cooperate to define a protected three-dimensional space 66 adjacent the spray opening 58. The protected space 66 extends forwardly of the spray tip 42 from the forward end thereof defined by the flat faces 42*a*, 42*b* and central recess 68, and it has a generally tunnel-shaped configuration extending between the elements 44*a*, 44*b*. The U-shaped frame elements 44*a* and 44*b* extend in a forward, downstream direction to provide the protected space 66 with a forward dimension which is greater than the zone of potential injection of the spray fan 60 and which is equal to about $\frac{3}{8}$ inch as measured from the spray opening 58. The illustrated $\frac{3}{8}$ inch dimension is an average size, and this dimension may be increased or decreased to provide an adequate protected space 66 consistent with the extent of the potential zone of injection as determined by the volume, spray angle, and pressure with which the tip is normally used. It should be appreciated that it is operator injection which is prevented by the guard as opposed to the mere contusing or bruising of the operator's skin.

The elements 44*a*, 44*b* are positioned close enough to one another to provide a protective frame barrier across the width of the recess 68. In the illustrated guard, the frame elements 44*a* and 44*b* are about 5/16 inch apart as measured in a direction extending across the recess 68 and they prevent the entry of an operator's finger into the protected space 66 and injection by the spray 60. Similarly, the legs of each of the U-shaped elements 44*a*, 44*b* are about $\frac{1}{4}$ inch apart as measured along the respective flat faces 42*a*, 42*b* and the openings defined by each of the elements 44*a*, 44*b* are small enough to effectively prevent the entry and injection of an operator's finger.

Accordingly, the frame elements 44*a*, 44*b* of the guard 44 cooperatively provide a cage-like enclosure about the spray opening 58 having the protected space 66 therein. The protected space 66 has a configuration which reflects that of the spray fan 60, and the frame elements thereby comprise a minimum structure which effectively prevents the injection of human skin pressed against the guard.

As shown in FIG. 3, the dimension of the space 66 between the elements 44*a*, 44*b* is substantially greater than the thickness of the spray 60 as developed by its atomization as it passes through the space 66. Accordingly, the spray 60 will pass between the elements 44*a*, 44*b* and through the protected space 66 without connecting the guard 44. However, it should be appreciated that the dimensions of the spray fan 60 are not precise and spray pressure variations including on-off operation of the spray gun 10 may result in some random paint particles adjacent the periphery of the spray which may engage the guard 44. Generally, the smooth cylindrical surfaces and the relatively small surface area of the guard are not conducive to the collection of such random paint particles and, to the extent that paint is collected by the guard, it does not tend to interfere with the spraying process. Thus, the minimization of the guard structure and surface area serves not only to permit the substantially unrestricted flow of atomization air, but also aids in the avoidance of paint build-up on the guard. Moreover, the minimized guard structure results in an exceptionally lightweight guard and its weight is effectively not perceivable by a user of the spray gun.

While a preferred embodiment of the invention has been described in considerable detail, it will be understood that various rearrangements and modifications may be resorted to without departing from the scope of the invention as defined in the following claims.

What is claimed is:

1. An airless spray tip adapted to be connected at its inlet end to a source of liquid to be sprayed through a spray opening at its discharge end, said spray tip having a protective guard comprising a frame structure extending from said spray tip adjacent said spray opening at its discharge end, said frame structure having a maximum lateral dimension substantially equal to or less than that of said spray tip and defining a three-dimensional space of sufficient dimension as measured from the spray opening to prevent the injection of human skin pressed against said guard by liquid being sprayed, and said frame structure permitting the substantially unrestricted flow of atomization air into said space.

2. An airless spray tip as set forth in claim 1, wherein said frame structure comprises oppositely disposed wire members having legs mounted to said spray tip.

3. An airless spray tip as set forth in claim 1, wherein said three-dimensional space has a minimum dimension as measured from the spray opening as measured in a downstream direction substantially equal to at least about $\frac{3}{8}$ of an inch.

4. An airless spray tip as set forth in claim 1, wherein said spray opening is an elongated spray opening adapted to provide a flat fan spray of liquid, said frame structure comprises a pair of substantially planar frame arrays, one of said planar frame arrays being located on each side of said elongated spray opening and disposed in substantially parallel relationship with the major dimension of said elongated spray opening.

5. An airless spray tip as set forth in claim 4, wherein each of said planar frame arrays is provided by a U-shaped wire member having spaced legs, the legs of said member being received within bores in said spray tip.

6. An airless spray tip having a forward end including an elongated spray opening, a rearward end including an inlet adapted to be connected to a source of liquid to be sprayed through said spray opening and to be emitted as a flat fan spray, and a protective guard integrally extending from the forward end of the spray tip adjacent said spray opening, said protective guard comprising disjuncted guard elements disposed on opposite sides of said elongated spray opening to cooperatively define a three-dimensional space about said spray opening of sufficient dimension to prevent the injection of human skin pressed against said guard by liquid being sprayed.

7. An airless spray tip as set forth in claim 6, wherein said protective guard is permanently associated with said spray tip in a manner which discourages removal of the protective guard without structural damage thereto.

8. An airless spray tip as set forth in claim 6, wherein said guard elements have a substantially planar configuration and are disposed in substantially parallel relationship with the major dimension of said elongated spray opening.

9. An airless spray tip as set forth in claims 6 or 8, wherein said guard elements comprise open frame barriers having mounting legs extending from said spray tip.

10. An airless spray tip as set forth in claim 9, wherein said mounting legs are secured within bores in said spray tip.

11. An airless spray tip as set forth in claim 10, wherein said mounting legs are secured within said bores by an adhesive.

12. An airless spray tip as set forth in claims 6 or 8, wherein said guard elements comprise open frame barriers of spring wire having mounting legs extending from said spray tip.

13. An airless spray tip as set forth in claim 12, wherein said frame barriers are U-shaped members, the bight of said U-shaped members being remote from said spray tip.

14. An airless spray tip as set forth in claim 12, wherein said frame barriers comprise a pair of U-shaped members, one of said members being located on each side of said elongated spray opening and having its bight remote from said spray tip.

15. An airless spray tip having a forward end including an elongated spray opening, a rearward end including an inlet adapted to be connected to an airless spray apparatus to receive liquid to be sprayed through said spray opening and to be emitted as a flat fan spray, and a guard comprising substantially planar, open frame barriers disposed on opposite sides of said elongated spray opening to cooperatively define a protected space about said spray opening of sufficient dimension to prevent the injection of human skin pressed against said guard by liquid being sprayed.

16. An airless spray tip as set forth in claim 15, wherein said frame barriers are disjuncted and respectively permanently associated with said spray tip in a manner which discourages removal without structural damage thereto.

17. An airless spray tip as set forth in claim 15, including a laterally extending mounting flange adapted to be entrapped within mounting means telescopically receiving and securing said spray tip to said airless spray apparatus, said mounting flange having a lateral dimension greater than the lateral dimension of said guard.

18. In an airless spray apparatus adapted to be connected to a source of liquid paint under pressure and including an airless spray tip having a generally cylindrical configuration, a forward end including a spray opening and an axially spaced rearward end including an inlet adapted to be connected to a source of liquid paint to be sprayed through said spray opening, a laterally extending mounting flange disposed adjacent said rearward end adapted to be entrapped within mounting means telescopically receiving and securing said airless spray tip to said airless spray apparatus, and a guard extending from said forward end of said spray tip, said guard defining a protected space about said spray opening of sufficient dimension to prevent the injection of human skin pressed against said guard by liquid paint being sprayed, said mounting flange having a lateral dimension greater than the lateral dimension of said guard to enable said spray tip to be telescopically received and secured to said airless spray apparatus with said mounting flange entrapped within said mounting means.

19. An apparatus as set forth in claim 18, wherein said guard comprises disjuncted guard elements cooperatively defining said protected space about said spray opening.

20. An apparatus as set forth in claim 19, wherein said spray opening is elongated to emit a flat fan spray and said disjuncted guard elements are disposed on opposite sides of the major dimension of said spray opening.

21. An apparatus as set forth in claim 20, wherein said disjuncted guard elements have a generally planar configuration and the planes of said guard elements are disposed in substantially parallel relationship with the plane of an emitted spray.

* * * * *